US009739535B2

(12) United States Patent
Pesonen et al.

(10) Patent No.: US 9,739,535 B2
(45) Date of Patent: Aug. 22, 2017

(54) METHOD FOR SMELTING NON-FERROUS METAL SULFIDES IN A SUSPENSION SMELTING FURNACE AND SUSPENSION SMELTING FURNACE

(71) Applicant: Outotec (Finland) Oy, Espoo (FI)

(72) Inventors: Lauri Pesonen, Oakville (CA); Peter Björklund, Espoo (FI)

(73) Assignee: Outotec (Finland) Oy, Espoo (FI)

( * ) Notice: Subject to any disclaimer, the term of this patent is extended or adjusted under 35 U.S.C. 154(b) by 217 days.

(21) Appl. No.: 14/440,006

(22) PCT Filed: Nov. 12, 2013

(86) PCT No.: PCT/FI2013/051065
§ 371 (c)(1),
(2) Date: Apr. 30, 2015

(87) PCT Pub. No.: WO2014/076368
PCT Pub. Date: May 22, 2014

(65) Prior Publication Data

US 2015/0300740 A1 Oct. 22, 2015

(30) Foreign Application Priority Data

Nov. 14, 2012 (FI) ..... 20126198

(51) Int. Cl.

| | |
|---|---|
| ***C22B 4/02*** | (2006.01) |
| ***C22B 4/08*** | (2006.01) |
| ***C22B 5/02*** | (2006.01) |
| ***C22B 5/12*** | (2006.01) |
| ***F27B 15/00*** | (2006.01) |
| ***F27D 3/18*** | (2006.01) |

(Continued)

(52) U.S. Cl.
CPC ..... *F27D 3/18* (2013.01); *C22B 4/02* (2013.01); *C22B 4/08* (2013.01); *C22B 5/02* (2013.01);

(Continued)

(58) Field of Classification Search
CPC ... C22B 15/0047; C22B 15/0052; C22B 4/04; C22B 4/08; C22B 5/12; F27D 3/18
See application file for complete search history.

(56) References Cited

U.S. PATENT DOCUMENTS

| | | | | |
|---|---|---|---|---|
| 4,017,307 A * | 4/1977 | Winterhager | ..... | C22B 5/00 266/162 |
| 4,857,104 A | 8/1989 | Victorovich et al. | | |
| 6,887,298 B1 * | 5/2005 | Kojo | ..... | C22B 15/0047 266/159 |

FOREIGN PATENT DOCUMENTS

| | | |
|---|---|---|
| CN | 201514112 U | 6/2010 |
| CN | 201514113 U | 6/2010 |

(Continued)

OTHER PUBLICATIONS

Machine Translation of CN 201514112 U, published Jun. 23, 2010.*

(Continued)

*Primary Examiner* — George Wyszomierski
*Assistant Examiner* — Tima M McGurthy Banks
(74) *Attorney, Agent, or Firm* — Chernoff Vilhauer LLP

(57) ABSTRACT

The invention relates to a method for smelting non-ferrous metal sulfides (13) in a suspension smelting furnace and to a suspension smelting furnace. The suspension smelting furnace comprises at least one injection means (18) for injecting at least one of fluid (19) and pulverous matter (20) into a settler (2) of the suspension smelting furnace from at least one of a first side wall structure (8) and a second side wall structure (9) of the settler (2) so that fluid (19) and/or pulverous matter (20) is injected into the settler (2) above a top surface (16) of a layer of melt (15) in the settler (2).

9 Claims, 1 Drawing Sheet

(51) Int. Cl.

| | |
|---|---|
| ***C22B 15/00*** | (2006.01) |
| ***F27B 1/20*** | (2006.01) |
| ***F27D 17/00*** | (2006.01) |

(52) U.S. Cl.

CPC ..... *C22B 5/12* (2013.01); *C22B 15/0052* (2013.01); *F27B 1/20* (2013.01); *F27D 17/008* (2013.01); *F27D 2003/185* (2013.01)

(56) References Cited

FOREIGN PATENT DOCUMENTS

| | | |
|---|---|---|
| CN | 102690919 A | 9/2012 |
| JP | 2000-129368 | 5/2000 |
| WO | 00/70103 | 11/2000 |
| WO | 2007/113375 | 10/2007 |

OTHER PUBLICATIONS

Search report from priority Finnish Application No. 20126198, dated Jul. 8, 2013, 1 pg.

Search report from priority International Application No. PCT/FI2013/051065, dated Feb. 10, 2014, 4 pgs.

Tang, Motang, "Pyrometallurgical Equipment," Metallurgical Industrial. Publishing House, Nov. 30, 2003, pp. 216-225.

Notification of the First Office Action prepared by the State Intellectual Property Office of the People's Republic of China for CN201380059436.1, notified Jul. 19, 2016, 9 pages.

Notification of the First Office Action prepared by the State Intellectual Property Office of the People's Republic of China for CN201380059436.1, notified Mar. 8, 2017, 8 pages.

* cited by examiner

METHOD FOR SMELTING NON-FERROUS METAL SULFIDES IN A SUSPENSION SMELTING FURNACE AND SUSPENSION SMELTING FURNACE

CROSS-REFERENCE TO RELATED APPLICATIONS

This is a national stage application filed under 35 USC 371 based on International Application No. PCT/FI2013/051065 filed Nov. 12, 2013 and claims priority under 35 USC 119 of Finnish Patent Application No. 20126198 filed Nov. 14, 2012.

STATEMENT REGARDING FEDERALLY SPONSORED RESEARCH OR DEVELOPMENT

Not applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY INVENTOR OR A JOINT INVENTOR

Not applicable

BACKGROUND OF THE INVENTION

The invention relates to a method for smelting non-ferrous metal sulfides in a suspension smelting furnace.

The invention also relates to a suspension smelting furnace.

The invention relates to a method that takes place in the suspension smelting furnace, such as a flash smelting furnace or a flash converting furnace, and to a suspension smelting furnace, such as a flash smelting furnace or a flash converting furnace.

Publication WO 2007/113375 relates to a method for treating solids-containing process gas in a suspension smelting furnace, comprising directing the process gas from the reaction shaft of the suspension smelting furnace to a settler and, further, through a raised shaft to a waste heat boiler to cool the process gas, whereby, through one or more gas nozzles placed on the settler top wall, oxidizing gas is fed into the process gas flowing in the settler, whereby the amount of oxidizing gas is adjusted during the process so that the amount of sulfides contained in the solid matter of the process gas that is directed to the waste heat boiler is minimized. Publication WO 2007/113375 relates also to equipment for treating solids-containing process gas in a suspension smelting furnace, wherein the process gas is directed from the reaction shaft of the suspension smelting furnace to the settler and, further, through the raised shaft to the waste heat boiler to cool the process gas. One or more gas nozzles are arranged on the top wall of the settler for feeding oxidizing gas into the process gas flowing in the settler, whereby the amount of oxidizing gas can be adjusted during the process so that the amount of sulfides contained in the solid matter of the process gas that is directed to the waste heat boiler is minimized.

Publication WO 00/70103 relates to a method and equipment, whereby matte with a high non-ferrous metal content and disposable slag are produced simultaneously in a suspension-smelting furnace from non-ferrous sulfide concentrate. According to the invention, a carbonaceous reducing agent is charged to the settler of a suspension smelting furnace via tuyeres to the part of the furnace which has a reduced cross-sectional area.

BRIEF SUMMARY OF INVENTION

The object of the invention is to provide a method for smelting non-ferrous metal sulfides in a suspension smelting furnace and suspension smelting furnace having improved blending of fluid and/or pulverous matter into process gases which are created in the reaction space of the suspension smelting furnace.

The invention is based on arranging injection means for injecting at least one of fluid, such as liquid, for example small water droplets, and/or gas, for example technical oxygen, and pulverous matter, for example coal or coke powder, into the settler from at least one of the side wall structure of the settler so that at least one of fluid and pulverous matter is injected into the settler above the top surface of the layer of melt in the settler. By arranging injection means in this manner, fluid and/or pulverous matter fed by means of the injection means will be fed into the process gases in the settler and not into the melt in the settler with the result that the composition of the melt would be changed.

The invention can be used for different purposes in a suspension smelting furnace. The intended use depends on the furnace geometry, type of raw material to be smelted in the suspension smelting furnace and type of off-gas line i.e. type of system for processing process gases formed in the suspension smelting process after exiting the uptake shaft of the suspension smelting furnace.

One purpose is to oxidize residual sulfide particles in the dust created in the reaction shaft of the suspension smelting furnace into oxidic particles in order to easier create sulphate particles further down in the off-gas line.

Another purpose is to lower the temperature of the process gases which are created in the suspension smelting furnace and which are removed from the suspension smelting furnace via the uptake shaft.

Another purpose is to amend the composition of the particles in the process gases which are created in the suspension smelting furnace so that the particles, if and when, they stick to the inner walls of the settler or to the inner walls of the uptake shaft of the suspension smelting furnace and create build-up, the build-ups has a lower melting point compared to build-ups solely composed of particles in the process gases, i.e. melt away the buildup.

Another purpose is to amend the composition of the particles in the process gases which are created in the suspension smelting furnace and the same time lower the temperature of the process gas so that the particles are in solid form in the gas phase temperature, which minimizes the sticking of the particles to the sidewalls of the uptake shaft.

BRIEF DESCRIPTION OF THE SEVERAL VIEWS OF THE DRAWINGS

In the following the invention will described in more detail by referring to the figures, which

DETAILED DESCRIPTION OF THE INVENTION

Figure 1:
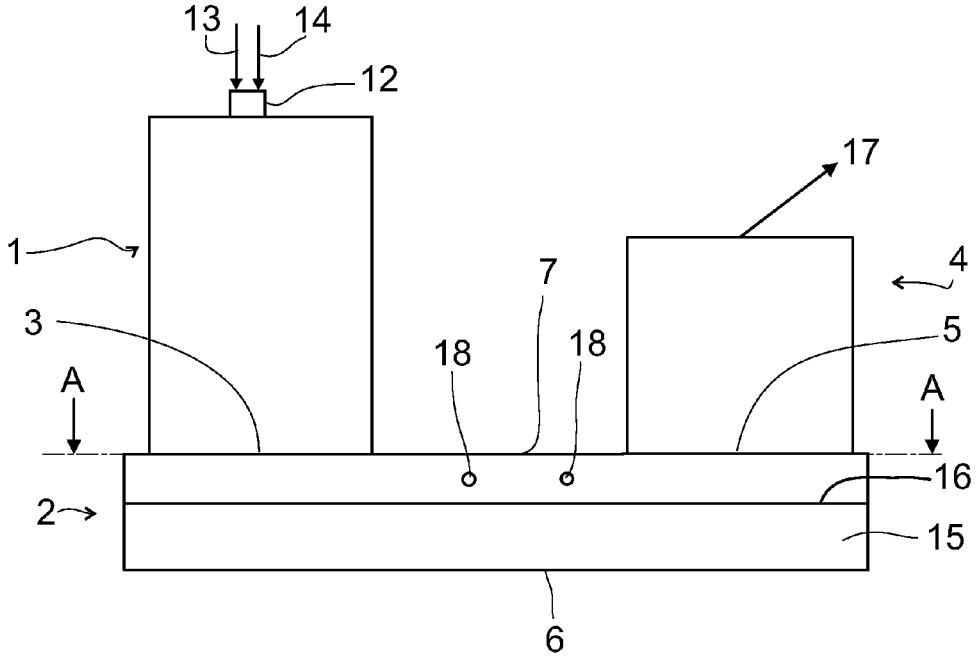
FIG. 1 is a principle drawing of a suspension smelting furnace according to a preferred embodiment of the invention.

The invention relates to a method for smelting non-ferrous metal sulfides in a suspension smelting furnace and to a suspension smelting furnace.

The figures shows an example of a suspension smelting furnace according to a preferred embodiment of the invention First the method for smelting non-ferrous metal sulfides such as sulfidic copper concentrate, sulfidic nickel concentrate, sulfidic zinc concentrate, or sulfidic matte, for example sulfidic copper matte, sulfidic nickel matte, or sulfidic zinc matte, in a suspension smelting furnace will be described in greater detail.

The method includes using a suspension smelting furnace comprising a reaction shaft 1, a settler 2 in communication with the reaction shaft 1 via a first communication point 3 that is formed between a lower end of the reaction shaft 1 and the settler 2, and an uptake shaft 4 in communication with the settler 2 via a second communication point 5 that is formed between the settler 2 and a lower end of the uptake shaft 4. The settler 2 comprises a bottom structure 6, a top wall structure 7, a first side wall structure 8 and a second side wall structure 9 between the bottom structure 6 and the top wall structure 7, and a first end wall structure 10 at one end of the settler 2 and a second end structure 11 at the opposite end of the settler 2.

The method included a feeding step for feeding by means of a concentrate burner 12 non-ferrous metal sulfides 13 and reaction gas 14 such as air, oxygen-enriched air or oxygen and possible also flux and/or fine dust into the reaction shaft 1 to have non-ferrous metal sulfides 13 and reaction gas 14 to react together in the reaction shaft 1 to produce melt (not shown or marked with a reference numeral).

The method includes also a collecting step for collecting melt from the reaction shaft 1 in the settler 2 so that a layer of melt 15 having a top surface 16 is be formed in the settler 2.

The method includes also a gas removing step for removing process gases 17 from the suspension smelting furnace via the uptake shaft 4.

The method includes additionally an arranging step for arranging at least one injection means 18 for injecting at least one of fluid 19, such as liquid for example small water droplets and/or gas for example technical oxygen, and pulverous matter 20 for example pulverized coal or coke into the settler 2 from at least one of the first side wall structure 8 and the second side wall structure 9 of the settler 2, so that at least one of fluid 19 and pulverous matter 20 injected into the settler 2 by means of said at least one injection means 8 will enter the settler 2 above the top surface 16 of the layer of melt 15 in the settler 2.

The method includes additionally an injecting step for injecting at least one of fluid 19 and pulverous matter 20 into the settler 2 by means of said at least one injection means 18.

In a preferred embodiment of the method the injecting step includes injecting at least one of fluid 19 and pulverous matter 20 into the settler 2 by means of at least one injection means 18 a direction parallel or almost or substantially parallel with the top surface 16 of the layer of melt 15. By doing so, mixing of fluid 19 and/or pulverous matter 20 fed by means of said at least one injection means 18 with the layer of melt 15 in the settler 2 can more effectively be avoided, because the risk that a jet containing fluid 19 and/or pulverous matter 20 hits the top surface of the layer of melt 15 is in this embodiment reduced.

In another preferred embodiment of the method the injecting step constitutes of injecting at least one of fluid 19 and pulverous matter 20 into the settler 2 by means of at least one injection means 18 a direction parallel with the top surface 16 of the layer of melt 15.

Figure 2:
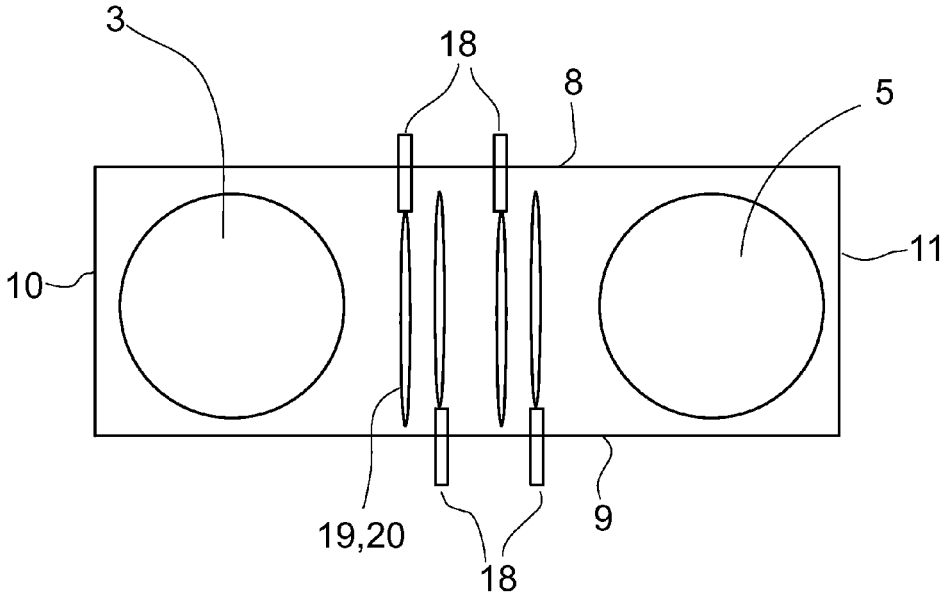
FIG. 2 shows the suspension smelting furnace shown in FIG. 1 as cut along line A-A in FIG. 1.

In a preferred embodiment of the method the arranging step includes arranging injection means 18 at both the first side wall structure 8 of the settler 2 and the second side wall structure 9 of the settler 2. In this preferred embodiment of the method, the arranging step included preferably, but not necessarily, arranging the injection means 18 in the arranging step in an unaligned configuration so that the injection means 18 at the first side wall structure 8 points at the opposite second side wall structure 9 and so that the injection means 18 at the second side wall structure 9 points at the opposite first side wall structure 8 as is shown in FIG. 2. In other words, in this preferred embodiment of the method, the arranging step included preferably, but not necessarily, arranging the injection means 18 in the arranging step so that the injection means 18 are not aligned in such manner that the injection means 18 at the first side wall structure 8 would points at the injection means 18 at the opposite second side wall structure 9 and vice versa. By arranging the injection means 18 in such unaligned configuration, the possibility that fluid 19 and/or pulverous matter 20 injected by means of injection means 18 at the first side wall structure 8 will collide in the middle of the settler 2 with fluid 19 and/or pulverous injected by means of injection means 18 from the opposite second side wall structure 9 is lower, and this leads to an evener distribution of fluid 19 and/or pulverous matter 20 injected by means of injection means 18 in the settler 2.

In a preferred embodiment of the method the arranging step includes arranging at least one injection means 18 at a region of the settler 2 between the first communication point 3 that is formed between the lower end of the reaction shaft 1 and the settler 2 and the second communication point 5 between the settler 2 and a lower end of the uptake shaft 4.

In a preferred embodiment of the method fluid 19 and/or pulverous matter 20 is in the injecting step injected into the settler 2 by means of said at least one injection means 18 above the top surface 16 of the layer of melt 15 in the settler 2.

In a preferred embodiment of the method fluid 19 and/or pulverous matter 20 is in the injecting step injected into the settler 2 by means of said at least one injection means 18 into process gases 17 present in the settler 2 above the top surface 16 of the layer of melt 15 in the settler 2.

Next the suspension smelting furnace will be described in greater detail.

The suspension smelting furnace comprises a reaction shaft 1.

The suspension smelting furnace comprises additionally a concentrate burner 12 for feeding non-ferrous metal sulfides 13 such as sulfidic copper concentrate, sulfidic nickel concentrate, sulfidic zinc concentrate or sulfidic matte, for example sulfidic copper matte, sulfidic nickel matte, or sulfidic zinc matte, and reaction gas 14 such as air, oxygen-enriched air or oxygen and possible also flux and/or fine dust into the reaction shaft 1 to have non-ferrous metal sulfides 13 and reaction gas 14 to react together in the reaction shaft 1 to produce melt.

The suspension smelting furnace comprises additionally a settler 2 in communication with the reaction shaft 1 via a first communication point 3 that is formed between a lower end of the reaction shaft 1 and the settler 2, wherein the settler 2 is adapted for receiving melt from the reaction shaft 1 so that a layer of melt 15 having a top surface 16 is formed in the settler 2. The settler 2 comprises a bottom structure 6, a top wall structure 7, a first side wall structure 8 and a second side wall structure 9 between the bottom structure 6 and the top wall structure 7, and a first end wall structure 10 at one end of the settler 2 and a second end structure 11 at the opposite end of the settler 2.

The suspension smelting furnace comprises additionally an uptake shaft 4 for removing process gases 17 from the suspension smelting furnace via the uptake. The uptake shaft 4 in communication with the settler 2 via a second communication point 5 that is formed between the settler 2 and a lower end of the uptake shaft 4.

The suspension smelting furnace comprises additionally at least one injection means 18 for injecting at least one of fluid 19, such as liquid, for example small water droplets, and/or gas, for example technical oxygen, and pulverous matter 20, for example pulverized coal or coke, into the settler 2 from at least one of the first side wall structure 8 and the second side wall structure 9 of the settler 2, so that at least one of fluid 19 and pulverous matter 20 is injected by means of said least one injection means 18 into the settler 2 above the top surface 16 of the layer of melt 15 in the settler 2.

In a preferred embodiment of the suspension smelting furnace, said at least one injection means 18 for injecting fluid 19 and/or pulverous matter 20 into the settler 2 is configured for injecting fluid 19 and/or pulverous matter 20 into the settler 2 in a direction parallel or almost or substantially parallel with the top surface 16 of the layer of melt 15.

In a preferred embodiment of the suspension smelting furnace, injection means 18 are arranged at both the first side wall structure 8 of the settler 2 and the second side wall structure 9 of the settler 2. In this preferred embodiment of the suspension smelting furnace, the injection means 18 are preferably, but not necessarily, arranged in an unaligned configuration so that the injection means 18 at the first side wall structure 8 points at the opposite second side wall structure 9 and so that the injection means 18 at the second side wall structure 9 points at the opposite first side wall structure 8 as is shown in FIG. 2. In other words, in this preferred embodiment of the suspension smelting furnace, the injection means 18 are preferably, but not necessarily, arranged so that the injection means 18 are not aligned in such manner that the injection means 18 at the first side wall structure 8 would point at the injection means 18 at the opposite second side wall structure 9 and vice versa. By arranging the injection means 18 in such unaligned configuration, the possibility that fluid 19 and/or pulverous matter 20 injected by means of injection means 18 from one side wall structure 8 will collide in the middle of the settler 2 with fluid 19 and/or pulverous matter 20 injected by means of injection means 18 from the opposite second side wall structure 9 is lower, which leads to an evener distribution of fluid 19 and/or pulverous injected by means of injection means 18 into the settler 2.

In a preferred embodiment of the suspension smelting furnace at least one injection means 18 is arranged in a region of the settler 2 between the first communication point 3 that is formed between the lower end of the reaction shaft 1 and the settler 2 and the second communication point 5 that is formed between the settler 2 and the lower end of the uptake shaft 4.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. Method for smelting non-ferrous metal sulfides in a suspension smelting furnace, wherein the method includes using a suspension smelting furnace comprising a reaction shaft-, a settler -in communication with the reaction shaft via a first communication point that is formed between a lower end of the reaction shaft and the settler, and an uptake shaft in communication with the settler via a second communication point that is formed between the settler and a lower end of the uptake shaft, wherein said settler comprises a bottom structure, a top wall structure, a first side wall structure and a second side wall structure between the bottom structure and the top wall structure, and a first end wall structure at one end of the settler and a second end structure at the opposite end of the settler, a feeding step for feeding by means of a concentrate burner non-ferrous metal sulfides and reaction gas into the reaction shaft to have non-ferrous metal sulfides and reaction gas to react together in the reaction shaft to produce melt, a collecting step for collecting melt in the settler so that a layer of melt having a top surface is be formed in the settler, and a gas removing step for removing process gases from the suspension smelting furnace via the uptake shaft, characterized by an arranging step for arranging at least one injector configured to inject at least one of fluid and pulverous matter into the settler from at least one of the first side wall structure and the second side wall structure of the settler so that fluid and/or pulverous matter is injected into the settler by means of said at least one injection means above the top surface of the layer of melt in the settler, by an injecting step for injecting fluid and/or pulverous matter into the settler by means of said at least one injection means, by injecting fluid and/or pulverous matter in the injecting step into the settler by means of said at least one injection means in a direction parallel or almost parallel with the top surface of the layer of melt, and by injecting fluid and/or pulverous matter in the injecting step into the settler by means of said at least one injection means into process gases present in the settler above the top surface of the layer of melt in the settler.

2. The method according to claim 1, characterized by arranging injection means at both the first side wall structure and the second side wall structure in the arranging step.

3. The method according to claim 2, characterized by arranging the injection means in the arranging step in an unaligned configuration so that the injection means at the first side wall structure points at the opposite second side wall structure and so that the injection means at the second side wall structure points at the opposite first side wall structure.

4. The method according claim 1, characterized by arranging at least one injection means in the arranging step in at least one of the first side wall structure and the second side wall structure of the settler in a region of the settler that is between the first communication point that is formed between the reaction shaft and the settler and the second communication point between the settler and the uptake shaft.

5. The method according to claim 1, characterized by injecting fluid and/or pulverous matter in the injecting step into the settler by means of said at least one injection means above the top surface of the layer of melt in the settler.

6. Suspension smelting furnace comprising a reaction shaft, a concentrate burner for feeding non-ferrous metal sulfides and reaction gas into the reaction shaft to have non-ferrous metal sulfides and reaction gas to react together in the reaction shaft to produce melt, a settler in communication with the reaction shaft via a first communication point that is formed between a lower end of the reaction shaft and the settler, wherein the settler is adapted for receiving melt from the reaction shaft so that a layer of melt having a top surface is formed in the settler wherein the settler comprises a bottom structure, a top wall structure, a first side wall structure and a second side wall structure between the bottom structure and the top wall structure, and a first end wall structure at one end of the settler and a second end structure at the opposite end of the settler, and an uptake shaft for removing process gases from the suspension smelting furnace via the uptake, wherein uptake shaft is in communication with the settler via a second communication point that is formed between the settler and a lower end of the uptake shaft characterized by at least one injector configured to inject at least one of fluid and pulverous matter into the settler from at least one of the first side wall structure and the second side wall structure of the settler so that fluid and/or pulverous matter is injected into the settler above the top surface of the layer of melt in the settler, by said at least one injection means for injecting fluid and/or pulverous matter into the settler is configured for injecting fluid and/or pulverous matter into the settler in a direction parallel or almost parallel with the top surface of the layer of melt, and by said at least one injector configured to inject at least one of fluid and pulverous matter into the settler is configured for injecting fluid and/or pulverous matter is injected into process gases present in the settler above the top surface of the layer of melt in the settler.

7. The suspension smelting furnace according to claim 6, characterized by injection means being arranged at both the first side wall structure and at the second side wall structure.

8. The suspension smelting furnace according to claim 7, characterized by the injection means being arranged at the first side wall structure and at the second side wall structure in an unaligned configuration so that the injection means at the first side wall structure points at the opposite second side wall structure and so that the injection means at the second side wall structure points at the opposite first side wall structure.

9. The suspension smelting furnace according to claim 6, characterized in by at least one injection means being arranged in at least one of the first side wall structure and the second side wall structure at a region of the settler that is between the first communication point that is formed between the lower end of the reaction shaft and the settler and the second communication point between the settler and the lower end of the uptake shaft.

* * * * *